US005733228A

United States Patent [19]

Stevens

[11] Patent Number: 5,733,228

[45] Date of Patent: Mar. 31, 1998

[54] FOLDING TREADMILL EXERCISE DEVICE

[76] Inventor: Clive Graham Stevens, 372 Hills Borough Road, Auckland, New Zealand

[21] Appl. No.: 667,180

[22] Filed: May 28, 1996

[51] Int. Cl.[6] ..... A63B 22/02

[52] U.S. Cl. ..... 482/54; 482/51

[58] Field of Search ..... 482/54, 51, 70, 482/71, 52

[56] References Cited

U.S. PATENT DOCUMENTS

| | | | |
|---|---|---|---|
| D. 207,541 | 5/1967 | Hesen | 482/54 |
| D. 211,801 | 7/1968 | Quinton | 482/54 |
| 931,394 | 8/1909 | Day | 482/54 |
| 3,731,917 | 5/1973 | Townsend | 482/54 |
| 4,679,787 | 7/1987 | Guilbault | 482/54 |
| 4,757,987 | 7/1988 | Allemand | 482/54 |
| 5,662,557 | 9/1997 | Watterson et al. | 482/54 |

*Primary Examiner*—Lynne A. Reichard
*Attorney, Agent, or Firm*—Norman E. Lehrer

[57] ABSTRACT

A folding treadmill exercise device includes a frame adapted to extend in a substantially vertical direction during operation of the device and a substantially planar bed having a plurality of rollers and an endless belt disposed about the rollers. The bed is slidably and pivotally connected to the frame proximate a first end of the bed, wherein the bed is adapted to selectively slide along the frame and simultaneously pivot relative to the frame between a substantially horizontal operative position and a substantially vertical storage position. A lift assist mechanism adapted to urge the bed towards an upper end of the frame is provided to facilitate movement of the bed between its operative and storage positions. The bed may also be adjustably connected to the frame wherein height of the first end of the bed is selectively adjustable relative to height of a second end of the bed when the bed is in the substantially horizontal operative position.

20 Claims, 3 Drawing Sheets

FOLDING TREADMILL EXERCISE DEVICE

BACKGROUND OF THE INVENTION

1. Field of the Invention

The present invention relates to exercise equipment and, more particularly, is directed to treadmill type exercise devices that are designed to fold to a compact size for convenient storage.

2. Description of the Prior Art

Motorized treadmill exercise devices are well known in the art. These devices typically include a horizontally extending bed having a movable belt upon which the user walks or runs and a vertically extending frame with handles for a user to grasp for support during use. Such devices are relatively large and, therefore, occupy a substantial amount of space. Accordingly, particularly in the event the treadmill device is being used in a home, rather than a commercial location such as a health or fitness club, it is desirable to store the devices when not in use. These treadmill exercise devices may be constructed in a wide range of configurations to facilitate such storage. Indeed, it is desirable to construct such an exercise device in which the bed can be moved between a horizontal operative position and a vertical storage position to make the overall size of the device relatively compact for storage.

In one type of manually operated treadmill, a forward end of the treadmill bed is pivotally mounted to a lower end of the vertically extending frame. A rearward end of the bed may thus be lifted to pivot the bed about its forward end into a vertical storage position. A latch may be utilized to secure the bed in this position and the device rolled on integral wheels to a desired storage location. One such prior art device is shown in U.S. Pat. No. 931,394 of A. Day.

While the pivotally folding manual treadmill may provide advantages over the non-folding treadmill device, it is not without significant limitations. In particular, such construction would not be readily adaptable to larger or heavier motorized treadmills in which a motor is generally fastened directly to the bed. The weight associated with the construction of the beds for such treadmills may make it prohibitively difficult for many users to lift the bed into the vertical storage position. Once in the upright storage position, the treadmill is tilted backwards onto a pair of wheels for moving to a storage area. The disadvantage of tilting the treadmill backwards is that the bed is tilted toward the person. The possibility exists that, because of the weight of the bed, the bed may unintentionally fall from the vertical storage into the horizontal operative position with sufficient force to cause injury to the user and/or damage to the treadmill. Even if latching means were provided to secure the bed in the vertical storage position, the danger exists that the latch may fail, or that the user may fail to fully latch the bed prior to attempting to move the exercise device. Furthermore, because the treadmill is tilted backwards, it is difficult to place the treadmill against a wall with the front of the treadmill facing outwardly. If the front of the treadmill is facing outwardly, the user cannot tilt the treadmill backwards to move it away from the wall.

These limitations and disadvantages may be partially alleviated by providing wheels on the bottom of the frame on only one side thereof such that a user would be required to tilt or pivot the frame in a direction in which the bed rests against the frame. When so tilted, gravity would tend to maintain the bed in its folded position against the frame, even in the event of a malfunctioning or improperly secured latch. This approach, while perhaps ameliorating the safety problem, fails to address the aforementioned problem associated with heavy beds that are difficult to move between operative and storage positions. In addition, this design requires a user to lift the bed from the back side of the frame, walk around to the front side of the frame, tilt the frame, and then move the treadmill to the storage area. Such movement is cumbersome, particularly in the event a relatively large treadmill is being utilized in a relatively small space, as is typical in home use situations. Furthermore, once in the storage location, the bed could fall from its vertical position in the event of failure of the latching mechanism.

It is therefore desirable to provide a folding treadmill type exercise device in which the bed is easy to raise and lower between operative and storage positions and, when the bed is so raised, may be tilted and rolled safely to a desired location without requiring the user to move to an opposite side of the device.

SUMMARY OF THE INVENTION

It is an object of the present invention to provide a foldable treadmill that does not suffer from the heretofore mentioned disadvantages and limitations.

It is another object of the present invention to provide a foldable treadmill that can be easily folded and safely moved to a storage area.

It is a further object of the present invention to provide a folding treadmill having a biasing system that assists in moving the treadmill from its horizontal operative position to its upright storage position.

The invention is characterized by a folding treadmill exercise device with a substantially vertical frame, a substantially planar bed having a plurality of rollers, and an endless belt disposed about the rollers, the belt defining a tread surface. A first end of the bed is mounted to the frame in such a manner that the bed is constrained for slidable and pivotable movement relative to the frame. The bed is adapted to selectively slide upwardly and downwardly along the frame and simultaneously pivot relative to the frame as it moves between a substantially horizontal operative position and a substantially vertical storage position.

In one embodiment of the invention, the folding treadmill exercise device includes a lift assist mechanism adapted to bias the bed upwardly as it moves into its storage position and downwardly to its operative position.

Advantageously, such construction substantially reduces the possibility of injury resulting from unintended movement of the bed from the storage to operative position. Moreover, the biasing of the bed enables a user to conveniently fold the bed into its storage position with a minimum of effort, regardless of the weight of the bed. A user is able to fold the treadmill to its storage position and move it to a storage location from a single vantage point on one side of the treadmill. Thus, the invention overcomes and eliminates the cumbersome task of having to lift the bed from one side of the treadmill, lock the treadmill in place, then step around to the opposite side to move the treadmill to a desired storage location.

The invention accordingly comprises the device, together with its parts, elements and interrelationships that are exemplified in the following disclosure, the scope of which will be indicated in the appended claims.

BRIEF DESCRIPTION OF THE DRAWINGS

A fuller understanding of the nature and objects of the present invention will become apparent upon consideration of the following detailed description taken in connection with the accompanying drawings, wherein.

DETAILED DESCRIPTION OF THE PREFERRED EMBODIMENT

Figure 1:
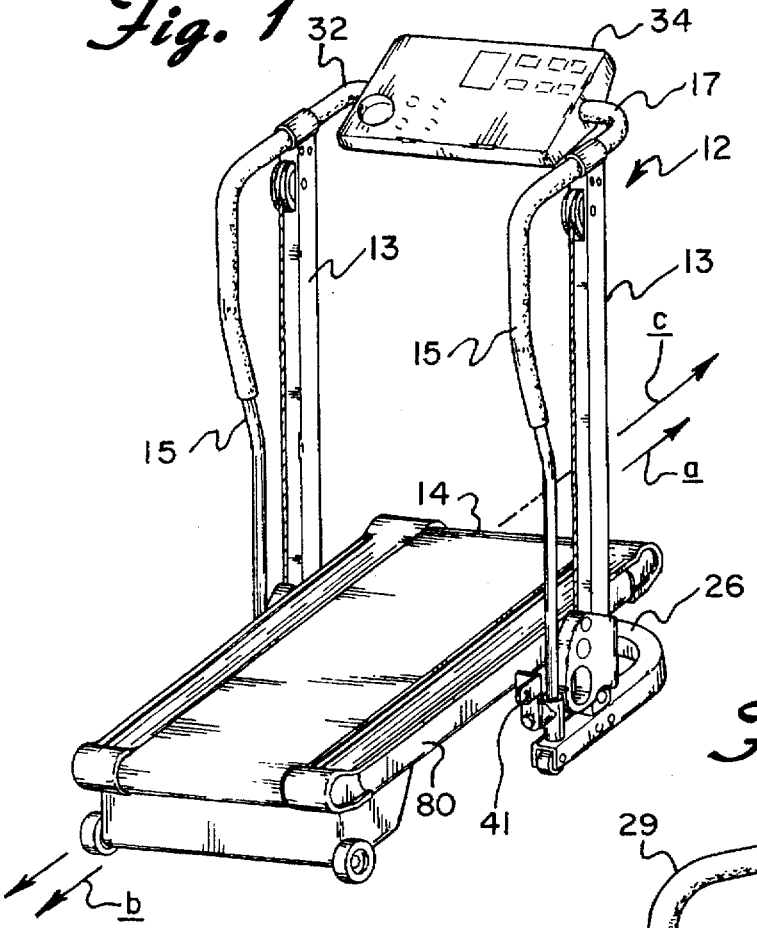
FIG. 1 is a perspective view of the exercise device embodying the present invention with the bed portion thereof in an operative position.
Figure 3:
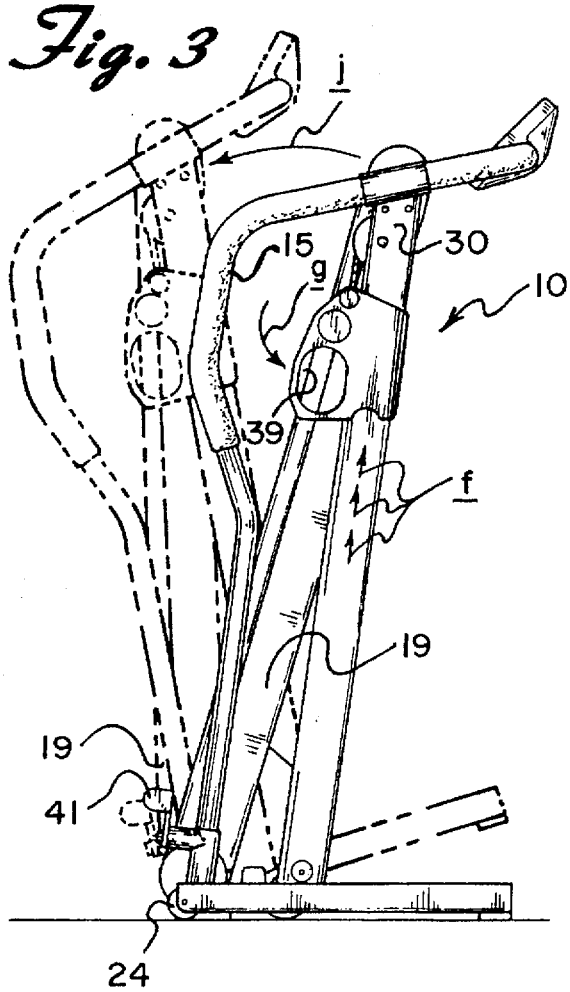
FIG. 3 is an elevational side view of the exercise device of FIG. 2, with the bed portion thereof in a storage position, with a partial phantom representation of the exercise device tilted backwards for movement to a storage area.

Briefly described, the present invention includes a folding treadmill exercise device 10 having a generally vertically extending frame 12 and a bed 14 which extends generally horizontally when in an operative position as shown in FIG. 1. A forward end of bed 14 is hingedly fastened on opposite sides thereof to a coupling 16 which is slidably fastened to frame 12. A user may fold the treadmill exercise device 10 simply by lifting coupling 16 to slide the forward end of bed 14 generally upwardly along the frame. As bed 14 slides upwardly along frame 12, it simultaneously pivots on coupling 16 as it moves from the horizontal operative position to a substantially vertical storage position as shown in FIG. 3. This construction offers several advantages over the prior art, including enhanced safety and ease of storage, as will be discussed in greater detail hereinafter.

Referring now to the drawings, particularly FIG. 1, it will be seen that bed 14 is supported by frame 12 which includes a pair of nominally vertically extending side rails 13 that are connected by a cross member 17, and a pair of handles 15. The handles 15 serve dual functions in that they provide support to a user in a conventional manner during operation of the exercise device 10 and they are used to facilitate movement of the device for storage as will be discussed hereinafter with regard to operation of the invention. Exercise device 10 is substantially symmetrical about a vertical plane bisecting bed 14 along an axis c, such that elevational side views of exercise device 10 taken from opposite sides of the plane are substantially mirror images of one another. Accordingly, throughout this disclosure, the invention will be shown and described with respect to one such side with the understanding that reference made to components disposed on each or opposite sides of the exercise device 10 will refer to the component shown as well as a second substantially identical, mirror image component disposed on the side opposite that shown. For explanatory purposes, throughout this disclosure, the term "forward" shall refer to the direction indicated by an arrow a in FIG. 1, while the rearward direction shall refer to the direction indicated by an arrow b.

Figure 2:
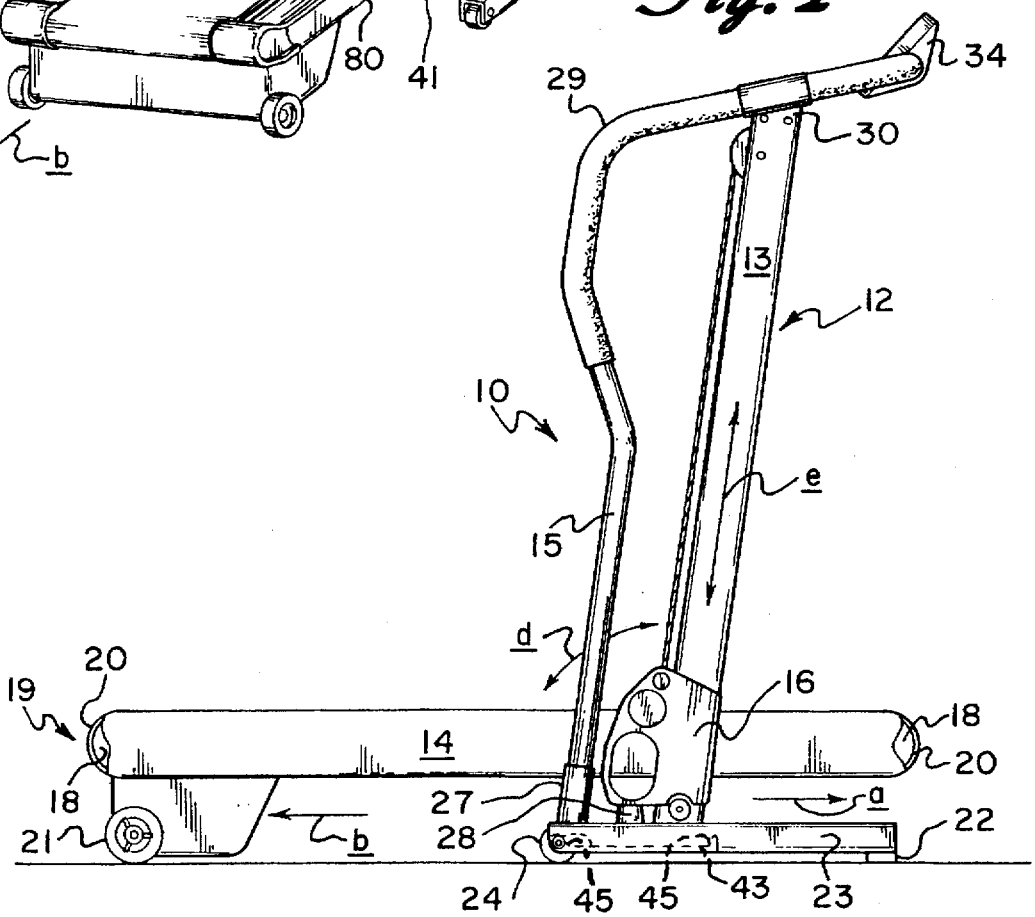
FIG. 2 is an elevational, partially broken away side view of the exercise device of FIG. 1.

Referring now to FIG. 2, bed 14 is shown as being disposed in its generally horizontal operative position on a support surface. The bed 14 is of generally conventional construction and includes a pair of side frame members or side rails 13. A pair of rollable support members or rollers 18 are rotatably supported between the side rails at opposite ends of the bed 14. An endless belt 20, which defines a tread surface, is disposed about rollers 18. In addition, in a preferred embodiment, belt 20 is driven in a conventional manner by a motor (not shown) disposed in motor housing 36. The motor housing and motor are preferably located at a rearward end 19 of bed 14, to facilitate movement of the bed between operative and storage positions, as will be discussed hereinafter with reference to the operation of the invention.

Figure 6:
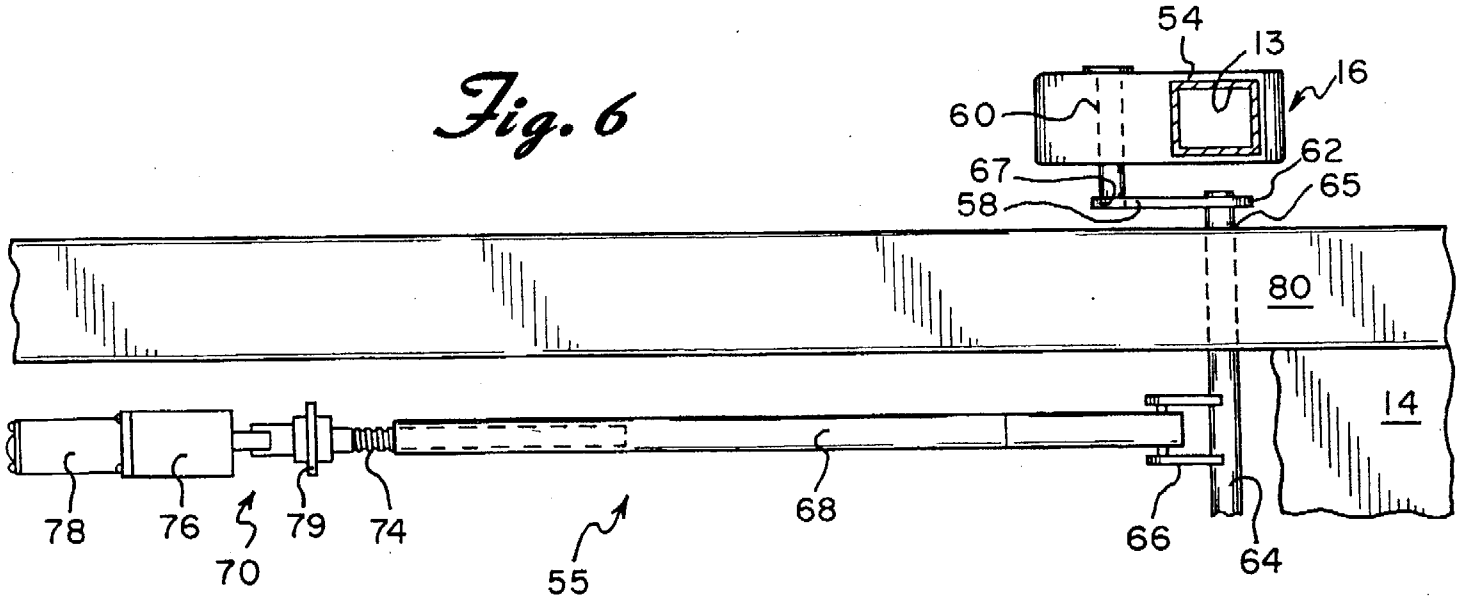
FIG. 6 is a reduced, cross-sectional, schematic view of portions of the exercise device taken along the lines 6—6 in FIG. 5.

As best shown in FIG. 6, a bed support shaft member 64 extends between side rails 80 of bed 14. Bed support shaft member 64, which is rotatably received in an opening or bearing 65 that is provided in each side rail 13, is disposed substantially perpendicular to the parallel side rails. One end of a linking arm 58 is secured to opposite ends of bed support shaft member 64. One end of a shoulder bolt 60 is threaded into coupling 16, an opposite end of the shoulder bolt being received in a bearing or opening 67 in linking arm 58. The connection of bed support shaft member 64 to coupling 16 via linking arm 58 is such that bed 14 pivots about shoulder bolt 60 as the bed is pulled upwardly on side rail 13 by upward movement of the coupling on the side rails.

Referring now to FIG. 2, each side of the rearward end 19 of bed 14 is supported by a ground engaging wheel 21. As previously discussed, a forward end of the bed 14 is rotatably or pivotally supported on opposite sides of the frame 12 by coupling 16 which is slidably fastened to each side rail 13. Accordingly, bed 14 is permitted to selectively rotate along an arc d and each coupling 16 is permitted to selectively slide along side rails 13 in the directions indicated by an arrow e as will be discussed in greater detail hereinafter.

Each side rail 13 is rigidly supported by a base 23 that is disposed substantially orthogonal to the side rails, or in a generally horizontal position when exercise device 10 is in the operative and stored position. A ground engaging, non-slip pad 22, preferably fabricated from resilient material such as rubber or a low durometer polymer, is disposed on a forward end of each base 23 to help secure the exercise device 10 when in its operative and stored position. The forward ends of each base 23 are preferably fastened to one another by an elongated connecting bar 26 (see FIG. 1) to form a substantially U-shaped member that provides the treadmill exercise device 10 with the requisite structural integrity. A ground engaging frame wheel 24 is rotatably mounted onto a rear end of each base 23 to facilitate movement of the treadmill exercise device 10 when in its storage position as will be discussed hereinafter. A stop 28, preferably fabricated from a material similar to that of pad 22, is disposed on each base 23 to engage coupling 16 when the coupling is in its lowermost position along the side rails 13 as shown.

As also shown, in a preferred embodiment, each handle 15 is received in and supported by a socket 27 that extends upwardly from the rearward end of each base 23 in a direction substantially parallel to the pair of side rails 13. An upper portion 29 of each handle 15 is fastened to an upper end 30 of the adjacent side rail 13. Each upper portion 29 terminates at cross member 17 which serves to fasten handles 15 to one another (see FIG. 1) to provide structural rigidity to the frame 12. In a preferred embodiment, cross member 17 may also serve to support a conventional control panel 34 or other conventional treadmill control and display panel. Preferably, an upper portion of the handles 15 are provided with a gripping member 32, for example a tubular foam member that fits over the handles.

Referring now to FIG. 3, coupling 16 is shown in its uppermost position relative to the side rail 13, having been moved along the side rail in the direction of an arrow f. A handhold 39, preferably comprising an oval bore passing through coupling 16, is provided to facilitate this movement, as will be discussed hereinafter. Such movement has served to simultaneously lift the forward end of the bed 14 in the direction of the arrow f while pivoting the bed in the direction of an arrow g to move the bed into its storage position. In this position, the bed 14 extends in a direction substantially parallel to rails 13. In a preferred embodiment, catch means 41, for example, a rectangular shaped member that is mounted to each socket 27 are provided to maintain the bed in the storage position. The catch means 41 is frictionally constrained to the socket 27 for rotatable movement from an opened or substantially vertical position to a substantially horizontal or locked position. When bed 14 is moved to its substantially vertical storage position, catch means 14 its locked position and engages bed 14, whereby the bed is prevented from moving downwardly. Once the bed 14 is so positioned and locked in place by catch means 41, a user may pivot the treadmill exercise device 10 about wheels 24 in the direction of an arrow j into the orientation shown in phantom to facilitate movement of the treadmill exercise device to a storage location. The specific movement of the treadmill exercise device 10 between operative and storage positions will be discussed more fully hereinafter with respect to the operation of the present invention.

Figure 4:
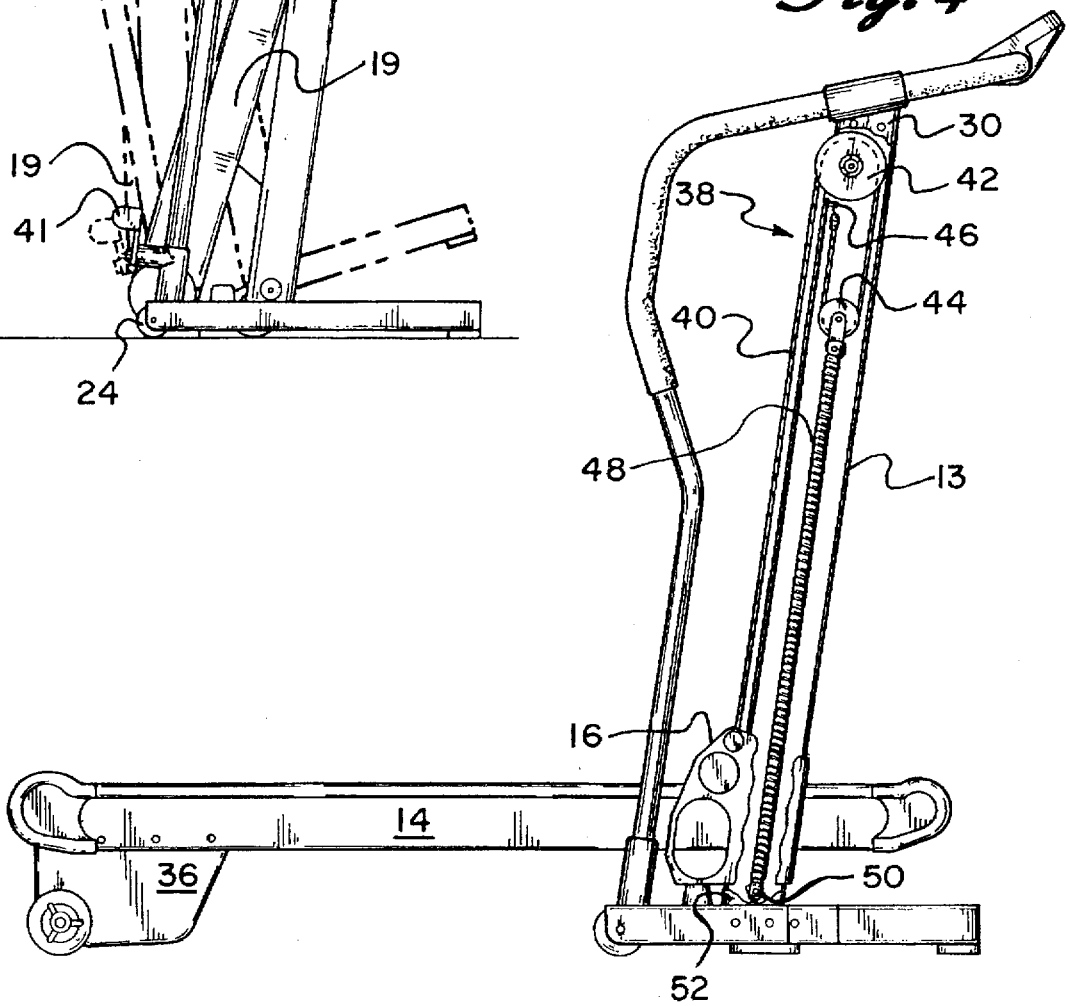
FIG. 4 is a view similar to that of FIG. 2, with portions of the exercise device broken away.

Referring now to FIG. 4, a lift assist mechanism 38 is disposed on each side rail 13. The assist mechanism 38 preferably includes a cable or strap 40 which extends from coupling 16 to a side rail pulley 42 disposed proximate upper end 30 of each side rail. From the side rail pulley 42, the cable 40 extends to a pulley 44 and then terminates at a cable anchor 46 disposed on the inner wall of the side rail 13 at a predetermined location proximate upper end 30. Pulley 44 is fastened to one end of a tension member 48, for example a coil tension spring 48, the other end of the spring being fastened to a spring anchor 50 disposed at a predetermined position proximate a lowermost end 52 of side rail 13. Spring 48 is in tension when treadmill exercise device 10 is disposed in its operative position as shown in FIG. 4, such that the lift assist mechanism 38 is adapted to urge the coupling 16 and, consequently, the bed 14 towards upper end 30 of the side rail 13 to facilitate movement of the bed between its operative and storage positions. In an alternative embodiment, tension member 48 is a resilient member such as an elastomeric cord, for example, a natural or synthetic rubber cord, or a shock cord.

Figure 5:
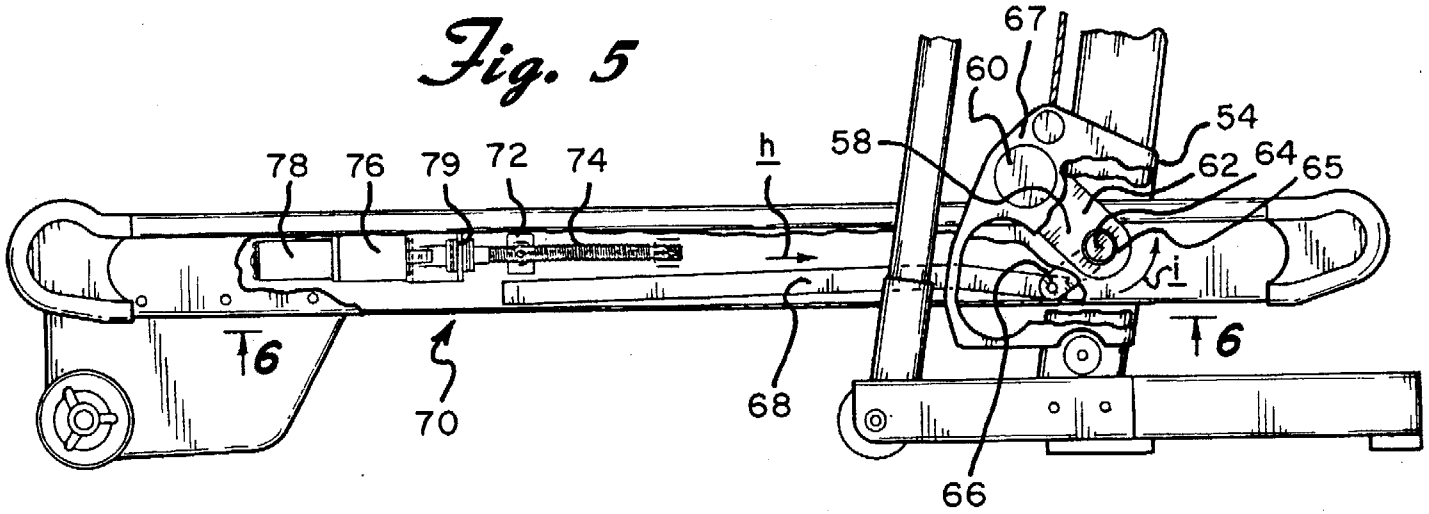
FIG. 5 is an enlarged, partially broken away, view of a portion of the exercise device of FIG. 4.

Referring now to FIG. 5, each coupling 16 includes a frame engagement portion 54 adapted to slide along the frame 12. Preferably, engagement portion 54 is a collar that slidably rides up and down on side rail 13 (see FIG. 6). Additionally, in a preferred embodiment, height adjustment means 55 are provided for raising and lowering the forward end of the bed 14. As also shown, a cam member 66 is attached to and depends from shaft 64 onto which a first end 68 of a linear actuator 70 is pivotally secured. Linear actuator 70 is of a conventional construction, preferably including a threaded block 72, worm drive 74, gearbox 76 and a motor 78, to move first end 68 in a linear direction relative to a second end that is rigidly secured to bed 14 as at brace member 79.

As previously noted, the height adjustment means 55 is provided for adjusting the height position of bed 14. Upon actuation of linear actuator 70 in a direction to raise the bed 14, threaded block 72, and thus end 68, is moved in the direction indicated by an arrow h. The forward movement of threaded block 72 causes cam member 66 to move forwardly and rotate bed support shaft member 64 in a counterclockwise direction as viewed in FIG. 5. As bed support shaft member 64 rotates, linking arm 58 pivots about pin 60 in the direction indicated by an arrow i, whereby the forward end of bed 14 is raised relative to a support surface on which treadmill exercise device is placed. Linear actuator 70 may also be actuated in the reverse direction to lower the forward end of the bed 14. Accordingly, the height adjusting means 55 serves to permit a user to selectively adjust the pitch or angle of inclination of the bed when in its operative position, within a predetermined range of motion. Preferably, linear actuator 70 is controlled from control panel 34.

Referring now to FIG. 6, in a preferred embodiment, shaft 64 extends through sidewall 80 of bed 14 completely across bed 14, through a similar sidewall (not shown) on the opposite side of the bed and terminates at the second mirror image coupling (also not shown), as discussed hereinabove. Cam member 66 is attached to shaft member 64 at a predetermined position between sidewalls 80. In this manner, a single linear actuator 70 may be utilized to adjust the pitch of the bed by simultaneously adjusting both couplings 16.

A preferred embodiment of the invention having been fully described, the following is a description of the operation thereof. As mentioned hereinabove, when bed 14 is in its operative position, as shown in FIGS. 1 and 2, a user may activate linear actuator 70 to adjust the pitch of the bed as desired. The treadmill exercise device may then be operated as a conventional exercise treadmill by activating the motor (if so equipped) and walking or running on belt 20. When finished using the device, after deactivating the motor, the user may simply grasp handhold 39 of each coupling 16 and slide each coupling to its uppermost position along the side rails 13 as shown in FIG. 3. Lift assist mechanism 38 facilitates this sliding movement by urging each coupling 16 towards its uppermost position on side rails 13. As previously mentioned, such movement will lift the forward end of bed 14 while permitting the bed to simultaneously pivot or rotate in the direction indicated by g in FIG. 3. This action will serve to permit rearward end 19 of the bed to roll on wheels 21 towards frame 12 until the bed reaches its substantially vertical storage position shown in FIG. 3. As best shown in FIG. 2, a support member 43 having raised stops 45 at its ends is attached to the inside of base member 23. When in the storage position, wheels 21 are on support members 43 and stops 45 hold the wheels 21, thereby preventing bed 14 from sliding downwards. In addition, the bed 14 is further secured in position by catch means 41. Once bed 14 is locked in place, the user standing on the rearward, or bed side of treadmill exercise device 10 may simply grasp each handle 15 at a convenient location on upper portion 29 thereof and pivot the treadmill exercise device 10 towards himself about frame wheels 24 in the direction indicated by arrow j into the position shown in phantom in FIG. 3. As shown, this pivoting movement serves to lift pads 22 off the ground and thus permit treadmill exercise device 10 to be conveniently rolled on wheels 24 to a desired storage location.

Thus, advantageously, the construction of the subject invention enables a user to conveniently fold bed 14 into its storage position with a minimum of effort, regardless of the weight of the bed. In addition, once so folded, this construction permits the treadmill exercise device 10 to be safely pivoted towards the bed 14 rather than requiring the user to move to the other side of the device and pivot in a direction away from the bed. In the event of a failure of catch means 41, while in the position shown in phantom of FIG. 3, rearward end 19 of bed 14 would only be permitted to move a negligible distance before engaging the ground. Thus, by permitting a user to both fold and move the treadmill from a single vantage point on one side of the device, the device of the subject invention device is significantly less cumbersome to operate than alternative prior art devices, which is particularly advantageous in the context of home use where space may typically be limited. In addition, this nominal elimination of the safety hazard of pivoting the exercise device towards the bed (and towards the user), eliminates the need to provide separate handles on the forward side of the frame to facilitate such pivotal or tilting movement of the device, thus simplifying construction to potentially lower the manufacturing costs of the subject invention relative to the prior art.

It should be recognized that any means for enabling a bed of an exerciser to be constrained for simultaneous sliding and pivoting relative to a frame, including but not limited to a track disposed along the frame that is engaged by a portion of the bed, should be construed to be within the scope of the subject invention.

The foregoing description is intended primarily for purposes of illustration. Although the invention has been shown and described with respect to an exemplary embodiment thereof, it should be understood by those skilled in the art that the foregoing and various other changes, omissions, and additions in the form and detail thereof may be made therein without departing from the spirit and scope of the invention.

What is claimed is:

1. A folding treadmill exercise device comprising:

(a) a frame adapted to be positioned on a support surface, said frame extending in a substantially vertical direction during operation of said treadmill exercise device;

(b) a substantially planar bed having a plurality of rollers and an endless belt disposed over said rollers, said belt defining a tread surface; and (c) coupling means operatively connecting said frame and said bed, said bed movable between a substantially horizontal operative position and a substantially vertical storage position, said bed constrained for simultaneous slidable movement and pivotal movement relative to said frame for movement proximate a first end of said bed, said bed being adapted to selectively slide along said frame, said bed simultaneously pivoting and sliding as it moves between said substantially horizontal operative position and said substantially vertical storage position.

2. The exercise device as claimed in claim 1 wherein said first end of said bed is disposed proximate a lower end of said frame when said bed is in said substantially horizontal operative position and said bed is disposed proximate an upper end of said frame when said bed is in said substantially vertical storage position.

3. The exercise device of claim 1 including a lift assist mechanism operatively connected to said frame and said bed, said lift assist mechanism adapted to assist in movement of said bed towards said upper end of said frame and facilitate sliding movement of said bed along said frame.

4. The exercise device of claim 3, wherein said lift assist mechanism includes a spring member operatively connected to said frame and said bed.

5. The exercise device of claim 1 wherein said coupling means includes a coupling that is slidable along said frame, said bed pivoting on said coupling as said coupling is slidably moved along said frame, said bed moving between said substantially horizontal operative position and said substantially vertical storage position as said coupling is slidably moved along said frame.

6. The exercise device of claim 5 including height adjustment means operatively connected to said frame and said bed for changing the height of a first end of said bed relative to the support surface when said bed is in said operative position.

7. The exercise device of claim 6, wherein said first end of said bed is a forward end.

8. The exercise device of claim 1, wherein said coupling means includes at least one frame engagement portion adapted to slide along said frame, at least one arm having an inner end and an outer end, said inner end being rotatably disposed on said coupling means and said outer end having a bed support member depending therefrom to support said bed proximate said first end thereof, said arm being selectively rotatable about said inner end along a predetermined arc length to alternately raise and lower said first end of said bed.

9. The exercise apparatus of claim 8 including an actuator operatively connected to said arm, said actuator adapted to selectively rotate said arm for raising and lowering said first end of said bed.

10. The exercise device of claim 9, wherein said actuator is a motor driven linear actuator.

11. The exercise device of claim 9 including a bed support shaft means rotatably mounted to said bed, said bed support shaft means mounted substantially perpendicular to a longitudinal axis of said bed, said arm operatively connected to said bed support shaft means.

12. The exercise device of claim 11 including cam means, said cam means fixedly attached to one said bed support shaft means and said actuator, and rotatably attached to the other of said bed support shaft means and said actuator.

13. The exercise device of claim 12, wherein said cam means is operatively connected to said bed support shaft means.

14. The exercise device of claim 13, wherein said cam means depends in a direction substantially orthogonal to said arm.

15. The exercise device of claim 1, wherein said coupling means includes a coupling and a linking arm, said coupling adapted to engage said frame for slidable movement relative thereto, said linking arm pivotally connected to said coupling.

16. An exercise device comprising:

(a) an elongated frame extending in a generally vertical direction during operation of said exercise device; and (b) a substantially planar bed having a plurality of rollable support members and an endless flexible tread member disposed over said rollable support members;

(c) a first end of said bed being operatively connected to said frame, said bed constrained for slidable and rotatable movement relative to said frame, said bed adapted to selectively slide along said frame and simultaneously pivot relative to said frame as said bed moves between a substantially horizontal operative position and a substantially vertical storage position.

17. The exercise device of claim 16, wherein said first end of said bed is adapted to move in a direction substantially parallel to said frame and a second end of said bed is adapted to move in a direction substantially perpendicular to said frame.

18. The exercise device of claim 17, wherein said bed is disposed substantially orthogonally to said frame when disposed in said operative position and is disposed substantially parallel to said frame when disposed in said storage position.

19. A folding treadmill exercise device comprising:

(a) a frame adapted to be positioned on a support surface, said frame including a pair of side members and a cross member, said side members being substantially vertical and said cross member being substantially horizontal, said side members and said cross member being operatively connected together to form an integral structure;

(b) a treadmill bed; and (c) coupling means operatively connected to said side members for slidable movement relative thereto, said coupling means operatively connected to said bed, said bed constrained for pivoting movement relative to said coupling means;

(d) said bed movable between a substantially horizontal operative position and a substantially vertical storage position, said coupling means slidable in a substantially vertical direction along said side members, said bed constrained for simultaneous slidable movement and pivotal movement relative to said frame by said coupling means as said coupling means is slidably moved along said side members, said bed simultaneously sliding between said substantially horizontal operative position and said substantially vertical storage position as said coupling means is slidably moved in a substantially vertical direction along said side members.

20. The exercise device of claim 19, wherein said coupling means includes a coupling and a linking arm, said coupling adapted to engage said side members of said frame for slidable movement relative thereto, said linking arm pivotally connected to said coupling, said bed operatively connected to said linking arm.

* * * * *